United States Patent [19]

Penkunas et al.

[11] Patent Number: 5,007,957

[45] Date of Patent: Apr. 16, 1991

[54] METHOD FOR PRODUCING TUNGSTEN CARBIDE GRADE POWDERS SUITABLE FOR ISOSTATIC COMPACTION

[75] Inventors: Joseph J. Penkunas; Theodore E. Smith, Jr., both of Sayre, Pa.

[73] Assignee: GTE Products Corporation, Stamford, Conn.

[21] Appl. No.: 579,518

[22] Filed: Sep. 10, 1990

[51] Int. Cl.[5] ..... B22F 1/00

[52] U.S. Cl. ..... 75/252; 419/14; 419/15; 419/17; 419/18; 419/36; 419/37; 419/68; 419/32; 419/33

[58] Field of Search ..... 419/36, 37, 68, 14, 419/15, 17, 18, 32, 33; 75/252

[56] References Cited

U.S. PATENT DOCUMENTS 4,886,638 12/1989 Penkunas et al. ..... 419/15

4,902,471 2/1990 Penkunas et al. ..... 419/33

*Primary Examiner*—Stephen J. Lechert, Jr.

*Attorney, Agent, or Firm*—L. Rita Quatrini; Elizabeth A. Levy

[57] ABSTRACT

A method for producing metal carbide grade powders suitable for isostatic compaction which comprises combining a binder metal powder with an esterified wax and heating the wax to a temperature above the melting point of the wax to melt the wax and maintain it in the molten state to form a first mixture, with the amount of wax being sufficient to result in a level of wax in the subsequently produced second mixture of no greater than about ½% by weight, combining a metal carbide powder component with the first mixture while maintaining the wax in the molten state, forming a slurry of the second mixture and water, attritor milling the slurry at a temperature below the melting point of the wax, and removing water from the resulting attritor milled mixture to form the metal carbide grade powder.

5 Claims, No Drawings

METHOD FOR PRODUCING TUNGSTEN CARBIDE GRADE POWDERS SUITABLE FOR ISOSTATIC COMPACTION

BACKGROUND OF THE INVENTION

This invention relates to a method for producing metal carbide grade powders suitable for isostatic compaction techniques which involves combining the binder metal powder with an esterified wax prior to mixing with metal carbide. By the mixing of the wax with the binder metal first, the undersirable oxidation of the binder metal is prevented. Also a minimum amount of wax is needed and as a result, disintegration of parts during the dewaxing cycle is prevented and a desirable carbon level in the product powder is maintained.

Tungsten carbide grade powders are used in isostatic compaction to form parts that are used in applications such as can forming tools and rolling mill tools.

In the production of carbide grade powders such as tungsten carbide powders containing cobalt, care must be taken that the binder metal (cobalt) is not oxidized. Excess oxygen results in loss of strength in densified parts made from these powders.

In formation of parts or articles by isostatic compaction, the powder is mixed with a wax which serves as a binder. When the green article is formed the binder is burned out of the article prior to sintering. If the wax content is too high, the article can disintegrate after burn out of the binder due to cracks or excessive voids in the microstructure of the article. Therefore care must be taken that the wax content is not too high.

A method for producing metal carbide grade powder in which there is a minimum of oxidation of the binder metal and in which a minimum amount of wax can be used so that the powder is suitable for formation of high strength parts by isostatic compaction, would be desirable.

SUMMARY OF THE INVENTION

In accordance with one aspect of the invention, there is provided a method for producing metal carbide grade powders suitable for isostatic compaction which comprises combining a binder metal powder with an esterified wax and heating the wax to a temperature above the melting point of the wax to melt the wax and maintain it in the molten state to form a first mixture, with the amount of wax being sufficient to result in a level of wax in the subsequently produced second mixture of no greater than about ½% by weight, combining a metal carbide powder component with the first mixture while maintaining the wax in the molten state, forming a slurry of the second mixture and water, attritor milling the slurry at a temperature below the melting point of the wax, and removing water from the resulting attritor milled mixture to form the metal carbide grade powder.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

The present invention provides a method for producing metal carbide grade powder that is suitable for isostatic compaction. The oxidation of the binder metal is controlled. Furthermore this is accomplished by using a relatively low level of wax and by attritor milling in water. This is done by a method in which the wax is first combined with the binder metal powder to coat the particles of the binder metal before the addition of the metal carbide component as opposed to adding the wax to the binder metal and the metal carbide together.

Metal carbide powders that are especially suited to the practice of the invention are tungsten carbide, titanium carbide, tantalum carbide, vanadium carbide, molybdenum carbide, niobium carbide, chromium carbide, and combinations of these. Especially preferred is tungsten carbide. In the metal carbide powder one carbide can be the main component and one or more of the other carbides can be present in minor amounts. For example tungsten carbide can be the main component having minor amounts of constituents such as tantalum carbide, titanium carbide, vanadium carbide, niobium carbide, chromium carbide, molybdenum carbide and combinations of these.

The binder metal is typically cobalt, nickel or combinations of these.

The first step in forming the grade powder is to combine the binder metal powder with a solid esterified wax to form a first mixture. The preferred waxes are pure beeswax, carnauba wax, candellila wax and combinations of these, although other esterified waxes can be used. The amount of wax is sufficient to result in a level of wax in the subsequently produced second mixture of no greater than about ½% by weight. The binder metal powder and the wax are heated to a temperature above the melting point of the wax. In practical operation, the temperature should not be excessively high, only sufficiently high to maintain the wax in the molten state so that it efficiently coast the binder metal powder particles.

The resulting first mixture is then combined with a metal carbide powder component to form a second mixture with heat to maintain the wax in the molten state. The second mixture is then cooled.

A slurry is formed of the second mixture and water. This is done normally in an attritor mill in preparation for the subsequent attritor milling operation.

The slurry is then attritor milled at a temperature below the melting point of the wax. The water serves as the milling fluid because it is safe and economical. The milling time is sufficient to allow the complete mixing of the carbide, binder metal, and wax. The milling time is normally about 2 to 8 hours.

The water is then removed from the second mixture, typically by spray drying.

The resulting second mixture can now be used in the application in cold isostatic compaction to form green articles. One typical second mixture has the composition of about 3% to about 25% by weight cobalt, no greater than about ½% by weight wax, and the balance the tungsten carbide component. The green articles are then dewaxed to remove the wax binder and sintered at temperatures which are generally about 1350° C. to about 1540° C. to densify the articles. The resulting densified articles have high strength as there is essentially no oxidation of the binder metal and there is near stoichiometric carbon balance.

To more fully illustrate this invention, the following non-limiting example is presented.

EXAMPLE

A 150 kg batch of WC-15% by weight Co with about ½% by weight beeswax is prepared by placing about 22.5 kg of cobalt and about 0.754 kg of beeswax in a heater blender. The heat is applied, raising the material temperature to above about 65° C., preferably about 75° to 90° C., and held for about 30 minutes under nitrogen atmosphere. About 127.5 kg of WC is then added and the entire mix is heated to about 75° to 80° C. for about 10 minutes and then cooled while the blender is still running. The mix is then attritor milled in water and the water is removed by spray drying. As a result of the method of the present invention in which the wax is first mixed with the cobalt, there is less oxidation of the cobalt as shown by the measure of magnetic saturation of the sintered article which is about 140 to about 160 gauss $cm^2/g$ (87.5 to about 100% saturated). The microstructure of an article made by cold isostatic compaction of the powder yields a two phase balanced microstructure and increased strength when compared with the prior method in which articles are made from powder in which the wax is mixed with both the cobalt and the WC. In the latter method there is a relatively high oxidation of the cobalt as shown in the magnetic saturation values of about 100–120 gauss $cm^2/g$ (about 62.5 to about 75% saturated). The microstructure of the article made from powder produced by the prior method is a three phase microstructure which exhibits eta phase or near eta phase conditions. The article also has less strength than articles made from grade powders produced by the method of the present invention.

While there has been shown and described what are at present considered the preferred embodiments of the invention, it will be obvious to those skilled in the art that various changes and modifications may be made therein without departing from the scope of the invention as defined by the appended claims.

What is claimed is:

1. A method for producing metal carbide grade powders suitable for isostatic compaction, said method comprising:

(a) combining a binder metal powder with an esterified wax and heating said wax to a temperature above the melting point of said wax to melt said wax and maintain said wax in the molten state to form a first mixture, with the amount of wax being sufficient to result in a level of wax in the subsequently produced second mixture of no greater than about ½% by weight;

(b) combining a metal carbide powder component with said first mixture while maintaining said wax in said molten state;

(c) forming a slurry of said second mixture and water;

(d) attritor milling said slurry at a temperature below the melting point of said wax; and (e) removing water from the resulting attritor milled mixture to form said metal carbide grade powder.

2. A method of claim 1 wherein said binder metal is selected from the group consisting of cobalt, nickel, and combinations thereof.

3. A method of claim 1 wherein said wax is selected from the group consisting of beeswax, carnauba wax, candellila wax and combinations thereof.

4. A method of claim 1 wherein said metal carbide component is selected from the group consisting of tungsten carbide, tantalum carbide, titanium carbide, vanadium carbide, chromium carbide, niobium carbide, molybdenum carbide and combinations thereof.

5. A method of claim 1 wherein said second mixture consists essentially of in percent by weight no greater than ½ of said wax, about 3 to about 25 cobalt, and the balance tungsten carbide.

* * * * *